US007651140B2

(12) United States Patent
Leggio

(10) Patent No.: US 7,651,140 B2
(45) Date of Patent: Jan. 26, 2010

(54) DOOR SECURITY DEVICE

(76) Inventor: Richard Leggio, 21 Green Dr., Roslyn, NY (US) 11576

( * ) Notice: Subject to any disclaimer, the term of this patent is extended or adjusted under 35 U.S.C. 154(b) by 0 days.

(21) Appl. No.: 12/313,107

(22) Filed: Nov. 17, 2008

(65) Prior Publication Data

US 2009/0127870 A1 May 21, 2009

Related U.S. Application Data

(60) Provisional application No. 61/003,612, filed on Nov. 16, 2007, provisional application No. 61/010,778, filed on Jan. 11, 2008.

(51) Int. Cl.
*E05C 19/18* (2006.01)

(52) U.S. Cl. ..... 292/288; 292/342; 292/343; 16/82

(58) Field of Classification Search ..... 292/338, 292/339, 342, 343, 288; 16/82; 49/394
See application file for complete search history.

(56) References Cited

U.S. PATENT DOCUMENTS

| | | | | | |
|---|---|---|---|---|---|
| 77,122 | A * | 4/1868 | Stevens | 16/82 |
| 564,294 | A * | 7/1896 | Shepard | 292/67 |
| 587,131 | A * | 7/1897 | Markert | 292/140 |
| 1,082,432 | A * | 12/1913 | Mertsheimer | 292/1 |
| 1,808,393 | A * | 6/1931 | Wecker | 292/338 |
| 1,895,146 | A * | 1/1933 | Brown | 292/228 |
| 2,497,697 | A * | 2/1950 | Smith | 292/74 |
| 2,703,728 | A * | 3/1955 | Raber | 292/288 |
| 3,378,293 | A * | 4/1968 | Silk | 292/202 |
| 3,563,586 | A * | 2/1971 | Creamer et al. | 292/144 |
| 3,805,322 | A * | 4/1974 | Serrano | 16/82 |
| 3,833,963 | A * | 9/1974 | Waters | 16/82 |
| 3,977,714 | A * | 8/1976 | Trotter | 292/343 |
| 4,178,026 | A * | 12/1979 | Sinkhorn | 292/295 |
| 4,198,088 | A * | 4/1980 | Tochihara | 292/288 |
| 4,601,502 | A * | 7/1986 | Van Dyke | 292/252 |
| 4,631,776 | A * | 12/1986 | King | 16/82 |
| 4,797,970 | A * | 1/1989 | Charlton | 16/82 |
| 5,135,273 | A * | 8/1992 | MacCalder | 292/338 |
| 5,199,759 | A * | 4/1993 | Anderson | 292/288 |
| 5,395,143 | A * | 3/1995 | Chesterton | 292/57 |
| 5,454,610 | A * | 10/1995 | Taylor et al. | 292/339 |
| 5,890,751 | A * | 4/1999 | Seffinga | 292/67 |
| 6,336,245 | B1 * | 1/2002 | Sakakibara | 16/82 |
| 6,345,849 | B1 * | 2/2002 | Yen | 292/343 |
| 6,360,779 | B1 * | 3/2002 | Wagner et al. | 138/92 |

(Continued)

*Primary Examiner*—Peter M Cuomo
*Assistant Examiner*—Kristina R Fulton
(74) *Attorney, Agent, or Firm*—Collard & Roe, P.C.

(57) ABSTRACT

A door security device for arranging on a floor surface proximate a bottom portion of an inwardly opening door includes a chock. The chock has a front surface extending substantially parallel to a plane of the door when the chock is in an operative position and a bottom surface adapted to rest against the floor surface. The bottom surface extends substantially perpendicular to the plane of the door when the chock is in the operative position. The chock has a top surface disposed between the front and bottom surfaces. An opening extends through the chock from the top surface to the bottom surface. The device also includes a pin sized to be received in the opening, a hollow tube for inserting into a hole in the floor surface and a cap for covering a top portion of the hollow tube.

8 Claims, 2 Drawing Sheets

U.S. PATENT DOCUMENTS 6,378,917 B1 * 4/2002 Jones ..... 292/42
6,471,264 B1 * 10/2002 Ryan ..... 292/338
7,367,596 B2 * 5/2008 Leung ..... 292/281
2009/0134640 A1 * 5/2009 Ruffino ..... 292/338

* cited by examiner

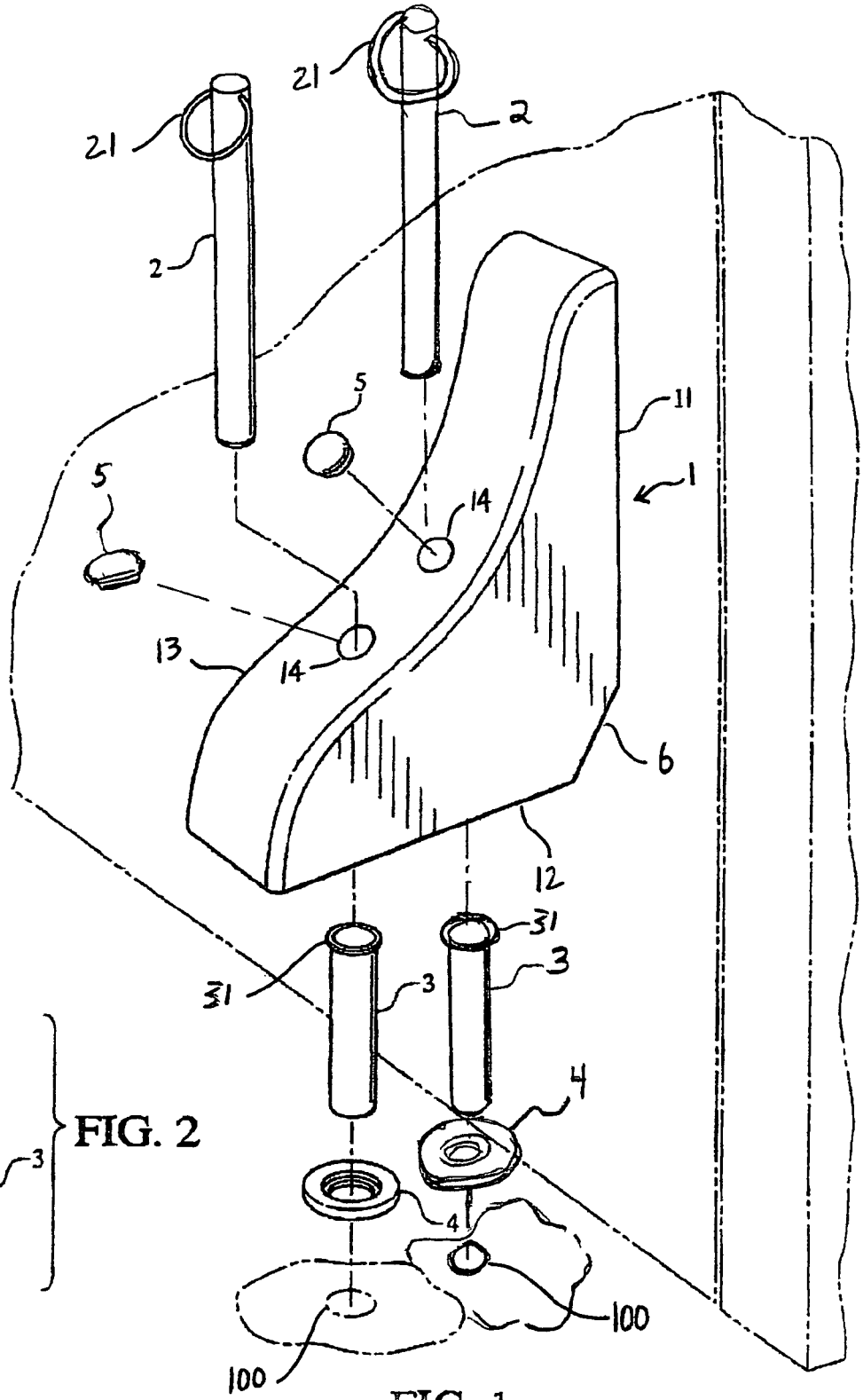
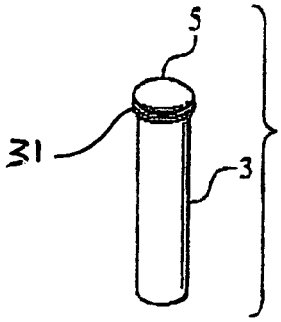
FIG. 2
FIG. 1

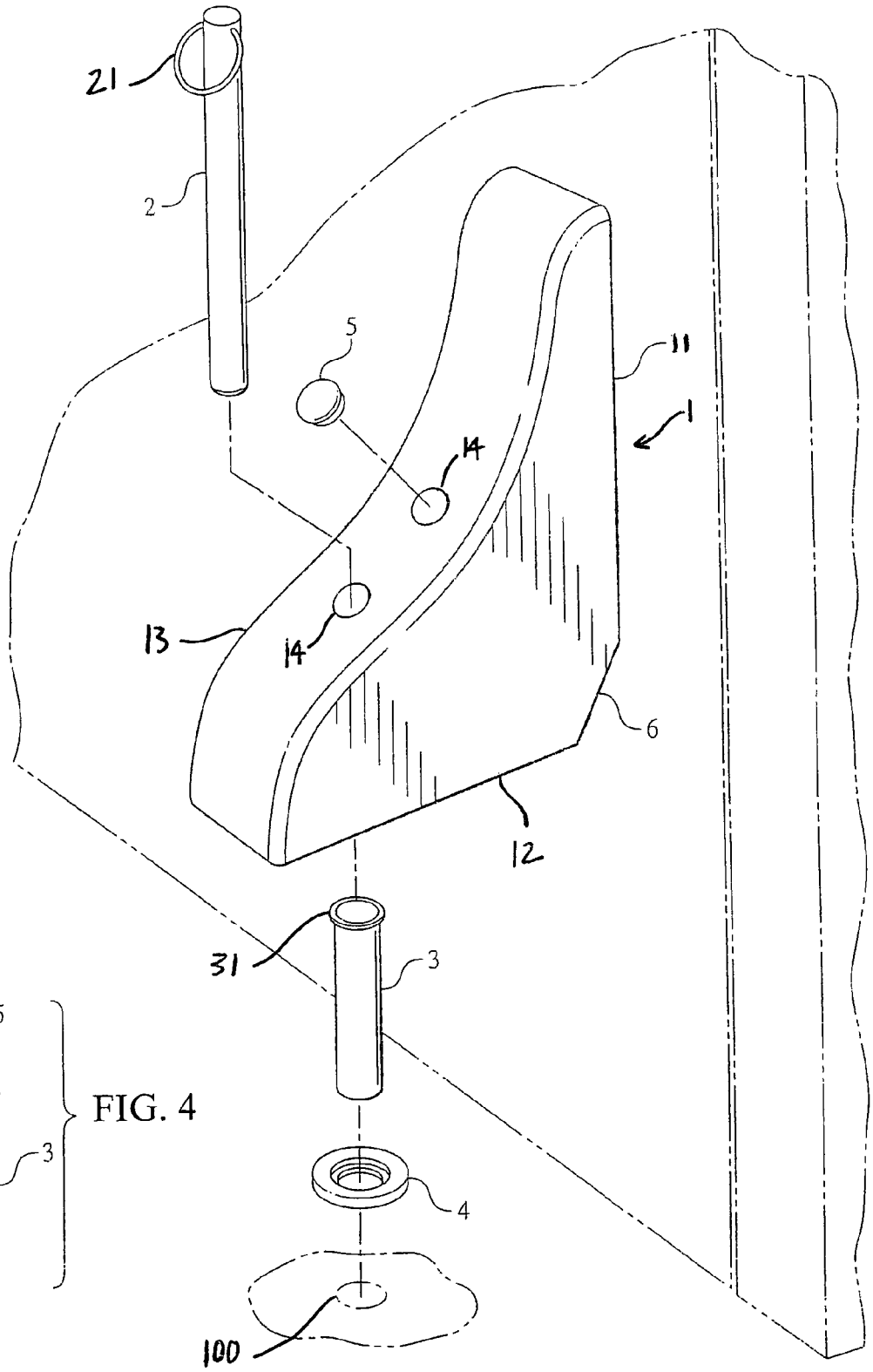
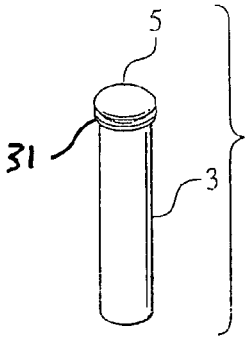
FIG. 4
FIG. 3

DOOR SECURITY DEVICE

CROSS REFERENCE TO RELATED APPLICATIONS

This application claims the benefit of U.S. Provisional Application No. 61/003,612 filed on Nov. 16, 2007 and U.S. Provisional Application No. 61/010,778 filed on Jan. 11, 2008.

BACKGROUND OF THE INVENTION

Field of the Invention

The invention relates to door security devices. In particular, the invention relates to devices for preventing unwanted intruders from entering through doors or doorways of residential or commercial structures either by force or by using unauthorized keys, access codes, passwords or the like.

SUMMARY OF THE INVENTION

A door security device according to an embodiment of the invention includes a chock which can be arranged on a floor surface proximate a bottom portion of an inwardly opening door. The chock has a front surface extending substantially parallel to a plane of the door when the chock is in an operative position. The chock has a bottom surface adapted to rest against the floor surface. The bottom surface of the chock extends substantially perpendicular to the plane of the door when the chock is in the operative position.

The chock has a top surface disposed between the front surface and the bottom surface. An opening extends through the chock from the top surface to the bottom surface.

The device further includes a pin sized to be received in the opening in the chock and a hollow tube for inserting into a hole provided in the floor surface. The hollow tube has a flanged top portion and the hollow tube is sized to receive the pin. A cap is provided, wherein the cap is adapted to cover a top portion of the hollow tube when the chock is not in the operative position.

In another aspect of the invention, a washer having an inner diameter larger than an outer diameter of the hollow tube and smaller than the flanged top portion of the hollow tube is provided.

In another aspect of the invention, the chock has a beveled surface disposed between its front surface and its bottom surface.

In another aspect of the invention the hollow tube has a closed bottom portion.

In another aspect of the invention, a ring is secured to a top portion of the pin to facilitate removal of the pin from the opening and the hollow tube.

A door security device according to a second embodiment of the invention includes a chock which can be arranged on a floor surface proximate a bottom portion of an inwardly opening door. The chock has a front surface extending substantially parallel to a plane of the door when the chock is in an operative position. The chock has a bottom surface adapted to rest against the floor surface. The bottom surface of the chock extends substantially perpendicular to the plane of the door when the chock is in the operative position.

The chock has a top surface disposed between the front surface and the bottom surface. A first opening extends thorough the chock from the top surface to the bottom surface and a second opening, spaced apart from the first opening, extends thorough the chock from the top surface to the bottom surface.

The device further includes a first pin sized to be received in the first opening in the chock and a second pin sized to be received in the second opening in the chock.

A first hollow tube is provided for inserting into a first hole in the floor surface and a second hollow tube is provided for inserting into a second hole in the floor surface. The first and second hollow tubes have respective flanged top portions and are sized to receive the respective first and second pins. First and second caps are provided, wherein the first and second caps are adapted to cover a respective top portion of the first and second hollow tubes when the chock is not in the operative position.

An advantage of a door security device according to an embodiment of the invention is that a chock is provided to prevent unwanted intruders from entering through doors or doorways of residential or commercial structures either by force or by using unauthorized keys, access codes, passwords or the like. A further advantage of a door security device according to an embodiment of the invention is that the chock may be quickly and easily secured in an operative position using one or more security pins.

Another advantage of a door security device according to an embodiment of the invention is that the chock may include a beveled surface for allowing clearance for a protruding door saddle, floor molding or the like, thereby allowing the front surface of the chock to lie flush against the door surface. A further advantage of a door security device according to an embodiment of the invention is that one or more caps may be provided for covering a top portion of one or more hollow tubes inserted in a hole in the floor surface, thereby providing a neat, finished appearance.

Another advantage of a door security device according to an embodiment of the invention is that the chock may be provided with two openings therethrough and two pins may be inserted into the respective openings to provide added strength and to prevent the door security device from pivoting (turning left or right) during an attempted forced entry. A further advantage of a two pin embodiment of the invention is that one pin may be removed from its corresponding opening in the chock, thereby allowing the chock to rotate or pivot so that the door may be opened slightly to allow a person situated on the inside of the door to observe the person or persons attempting to gain entry, while preventing the door from being opened enough to gain entry.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 1 shows an exploded perspective view of a door security device according to an embodiment of the invention;

FIG. 2 shows a tube and cap for a door security device according to an embodiment of the invention;

FIG. 3 shows an exploded perspective view of a door security device according to another embodiment of the invention; and FIG. 4 shows a tube and cap for a door security device according to an embodiment of the invention.

DETAILED DESCRIPTION OF THE DRAWINGS

Referring now in detail to the drawings and, in particular, FIG. 3 shows a door security device for arranging on a floor surface proximate a bottom portion of an inwardly opening door. The door security device is intended to prevent unwanted intruders from entering through a door or doorway of a residential or commercial structure by force or the use of unauthorized keys, access codes, passwords or the like.

As shown, the door security device includes a chock or block 1. The chock or block 1 may be made from any rigid material of sufficient strength to prevent opening of the door when chock 1 is in its operative position and secured as described hereinafter. For example, chock 1 may be made from hardwood, metal, plastic or combinations thereof. The dimensions of chock/block 1, including its thickness and height are such that the device is capable of preventing forced opening of the door. For example, chock 1 may be approximately two inches thick, eight inches high (surface adjacent to door) and six inches long (kick out surface resting on floor). These and all dimensions described herein are exemplary only and other dimensions are contemplated for the chock 1 and other components of the door security device.

The chock 1 may have any suitable shape, for example a wedge shape, a curved shape or a stylized shape, such as an animal or person. Chock 1 has a front surface 11 extending substantially parallel to a plane of the door when the chock 1 is in its operative position for preventing the door from opening. Chock 1 further has a bottom surface 12 adapted to rest against the floor surface. The bottom surface of chock 1 extends substantially perpendicular to the plane of the door when the chock 1 is in its operative position. Chock 1 also has a top surface 13 disposed between its front surface 11 and bottom 12 surface.

One or more openings or holes 14 are provided in the chock 1 and extend through chock 1 from its top surface to its bottom surface. One or more pins (security pins) 2 are provided. Pins 2 may be made from any hard material, for example metal or hardwood. Preferably pins 2 are made from a material which is non-corrosive. Pins 2 are of a length and diameter sufficient to secure chock 1 in place and prevent forced entry through the door. For example pin or pins 2 may be approximately six inches long and approximately three eighths of an inch in diameter. Pins 2 are sized to be received in and extend through the corresponding opening 14 in chock 1. As shown, a ring 21 may be secured to a top portion of pin or pins 2 to facilitate removal of the pin 2 from chock 1.

One or more holes 100 are machined, drilled or otherwise formed in the floor surface at a location where the door security device is to be installed. One or more a hollow tubes 3 are inserted into a corresponding floor opening provided in the floor surface. Hollow tube 3 includes a flanged top portion 31 for preventing the tube from sliding down into the hole 100 in the floor surface. Hollow tube 3 may be closed or sealed at its bottom portion.

Hollow tube 3 may be made form any suitable material, such as hardwood, metal or plastic. Preferably hollow tube 3 is made from a material which is non-corrosive. The hollow tube or tubes 3 are sized to receive a corresponding pin 2. For example hollow tube 3 may be approximately one half inch in diameter and four inches long. The flanged top portion 31 of hollow tube 3 may be approximately five eighths of an inch in diameter.

One or more caps 5 are provided. Cap or caps 5 can be made from any suitable material, for example hardwood, metal or plastic. Preferably cap 5 is made from a material which is non-corrosive. As shown in FIGS. 2 and 4, cap 5 is adapted to cover a top portion of hollow tube 3 when chock 1 is not in its operative position. Cap 5 has a thickness and diameter large enough to cap an associated hollow tube 3. For example cap 5 may have a diameter of approximately one half an inch. When the door security device is not in use, cap or caps 5 cover the hollow tube or tubes in the floor 3 to regain the continuity of the floor surface and provide a finished appearance. When the door security device is in use, the cap or caps 5 may be placed in receptacles or openings 14 provided in chock 1 so that the caps are readily accessible and not lost.

One or more washers 4 may be provided for use when the door security device is used with carpet or other relatively thick, soft floor coverings. Washer or washers 4 can be made from any suitable material, for example hardwood, metal or plastic. Preferably washer 4 is made from a material which is non-corrosive. Washer 4 can be beveled or flanged in shape.

The washer 4 is slid around a corresponding hollow tube 3 to increase the flange diameter so as to pull down and secure the soft flooring material (carpet, sponge, etc.) and prevent it from peeling or picking up. The thickness of washer 4 should be suitable for holding down the material surrounding hollow tube 3. Washer or washers 4 should have an inner diameter larger than an outer diameter of an associated hollow tube 3 and smaller than the flanged top portion 31 of the hollow tube 3. For example, washer 4 may have an inside diameter of approximately nine sixteenths of an inch and an outside diameter of approximately one inch.

A beveled surface 6 may be disposed between the front surface 11 of the chock 1 and the bottom surface 12 of the chock 1. Beveled surface 6 may be an angular or stepped cut, or any other configuration for allowing clearance for a protruding door saddle, floor molding or the like located adjacent to a bottom of the door. This allows the chock 1 to be positioned flush against the door.

In use, the door security device is placed flush, at the bottom of any door. Chock 1 is positioned with its bottom surface 12 resting on the floor and its front surface 11 flush against the door. One more pins 2 are inserted through the associated opening or openings in the chock and extend downwardly into a pre-drilled hole or holes 100 in the floor surface. The hole or holes 100 in the floor surface are sleeved with a hollow tube 3 having a flanged upper portion 31 to prevent it from falling through the hole.

With the chock 1 secured in place with the pin or pins 2, a front surface 11 of the chock 1 rising up the door and a bottom surface 12 of the chock 1 extending out onto the floor surface, the device is in an operative position to prevent forced entry through the door. Moreover, the device can be readily and easily removed by pulling out the pin or pins 2 and moving the chock 1 away from the door.

FIG. 3 shows an exemplary embodiment having one pin 2 and FIG. 1 shows an exemplary embodiment wherein two pins 2 are used to provide added strength. As shown in FIG. 1, chock 1 includes spaced apart first and second openings 14 extending through the chock from its top surface 13 to its bottom surface 12. A first pin 2 is received in the first opening 14 and a second pin 2 is received in the second opening 14.

The use of two pins 2 has the additional advantage of preventing the chock 1 from pivoting or turning when force is applied to the chock 1 during an attempted forced entry. Additionally, in the two pin embodiment, one pin 2 may be removed to allow the chock 1 to pivot or rotate away from the door. In particular, the front surface 11 of the chock 1 may be rotated away from the door, allowing the door to open slightly, while the remaining pin 2 secures the chock 1 in place and a side surface of the chock 1 prevents the door from opening more than is needed to provide a viewing area. Thus, the door may be opened slightly to allow a person situated on the inside of the door to observe the person or persons attempting to gain entry, while preventing the door from being opened enough to gain entry.

While a number of embodiments of the present invention have been shown and described, it is obvious that many changes and modifications may be made thereunto without departing from the spirit and scope of the invention.

What is claimed is:

1. A door security device for arranging on a floor surface proximate a bottom portion of an inwardly opening door, the door security device comprising:

a) a chock comprising:

a front surface extending substantially parallel to a plane of the door when said chock is in an operative position;

a bottom surface adapted to rest against the floor surface and extending substantially perpendicular to the plane of the door when said chock is in the operative position;

a top surface disposed between said front surface and said bottom surface;

an opening extending through said chock from said top surface to said bottom surface; and a beveled surface at an intersection of said front surface and said bottom surface for providing a clearance for a protruding structure located adjacent to the bottom portion of the door and for allowing said chock to be positioned flush against the door;

b) a pin sized to be received in said opening;

c) a hollow tube for inserting into a hole provided in the floor surface, said hollow tube comprising a flanged top portion, wherein said hollow tube is sized to receive said pin; and d) a cap, wherein said cap is adapted to cover a top portion of said hollow tube when said chock is not in the operative position.

2. The door security device according to claim 1, further comprising a washer having an inner diameter larger than an outer diameter of said hollow tube and smaller than said flanged top portion of said hollow tube.

3. The door security device according to claim 1, wherein said hollow tube has a closed bottom portion.

4. The door security device according to claim 1, further comprising a ring secured to a top portion of said pin to facilitate removal of said pin from said opening and said hollow tube.

5. A door security device for arranging on a floor surface proximate a bottom portion of an inwardly opening door, the door security device comprising:

a) a chock comprising:

a front surface extending substantially parallel to a plane of the door when said chock is in an operative position;

a bottom surface adapted to rest against the floor surface and extending substantially perpendicular to the plane of the door when said chock is in the operative position;

a top surface disposed between said front surface and said bottom surface;

a first opening extending through said chock from said top surface to said bottom surface;

a second opening spaced apart from said first opening and extending through said chock from said top surface to said bottom surface; and a beveled surface at an intersection of said front surface and said bottom surface for providing a clearance for a protruding structure located adjacent to the bottom portion of the door and for allowing said chock to be positioned flush against the door;

b) a first pin sized to be received in said first opening;

c) a second pin sized to be received in said second opening;

d) a first hollow tube for inserting into a first hole provided in the floor surface, said first hollow tube comprising a first flanged top portion, wherein said first hollow tube is sized to receive said first pin;

e) a second hollow tube for inserting into a second hole provided in the floor surface, said second hollow tube comprising a second flanged portion, wherein said second hollow tube is sized to receive said second pin;

f) a first cap, wherein said first cap is adapted to cover a top portion of said first hollow tube when said chock is not in the operative position; and g) a second cap, wherein said second cap is adapted to cover a top portion of said second hollow tube when said chock is not in the operative position.

6. The door security device according to claim 5, further comprising:

a first washer having an inner diameter larger than an outer diameter of said first hollow tube and smaller than said first flanged top portion of said first hollow tube; and a second washer having an inner diameter larger than an outer diameter of said second hollow tube and smaller than said second flanged top portion of said second hollow tube.

7. The door security device according to claim 5, wherein said first hollow tube has a first closed bottom portion and said second hollow tube has a second closed bottom portion.

8. The door security device according to claim 5, further comprising:

a first ring secured to a top portion of said first pin to facilitate removal of said first pin from said first opening and said first hollow tube; and a second ring secured to a top portion of said second pin to facilitate removal of said second pin from said second opening and said second hollow tube.

* * * * *